United States Patent [19]

Smith

[11] Patent Number: 4,903,846

[45] Date of Patent: Feb. 27, 1990

[54] VERTICAL STORAGE POLE ASSEMBLY AND METHOD

[76] Inventor: Marvin E. Smith, 7646 Devon Ave., Chicago, Ill. 60631

[21] Appl. No.: 166,830

[22] Filed: Mar. 4, 1988

Related U.S. Application Data

[63] Continuation of Ser. No. 808,061, Dec. 12, 1985, abandoned.

[51] Int. Cl.[4] ..... A47F 5/08

[52] U.S. Cl. ..... 211/113; 211/118

[58] Field of Search ..... 29/526 R; 211/113, 118, 211/195, 204, 13, 125; 403/292, 298, 265

[56] References Cited

U.S. PATENT DOCUMENTS

| | | | |
|---|---|---|---|
| 274,457 | 3/1883 | Brady | 211/113 X |
| 623,377 | 4/1899 | Leger | 211/113 |
| 1,005,870 | 10/1911 | Packer | 211/113 |
| 1,666,622 | 4/1928 | Hess | 211/204 |
| 1,691,123 | 11/1928 | Pajeau | 211/113 |
| 2,488,582 | 11/1949 | Cinamon | 211/113 |
| 2,706,563 | 4/1955 | Larson | 211/204 |
| 3,528,559 | 9/1970 | Miller | 211/195 |
| 3,532,224 | 10/1970 | Grubb et al. | 211/118 |
| 4,127,196 | 11/1978 | Boucher | 211/195 |
| 4,253,578 | 3/1981 | Rekow | 211/204 |
| 4,380,298 | 4/1983 | Harig | 211/204 |
| 4,573,590 | 3/1986 | Ellis | 211/118 X |
| 4,749,088 | 6/1988 | Workman et al. | 211/118 X |
| 4,819,817 | 4/1989 | Mar | 211/205 |

FOREIGN PATENT DOCUMENTS

| | | | |
|---|---|---|---|
| 2574274 | 6/1986 | France | 211/118 |

*Primary Examiner*—Alvin C. Chin-Shue
*Assistant Examiner*—Sarah A. Lechok
*Attorney, Agent, or Firm*—Hill, Van Santen, Steadman & Simpson

[57] ABSTRACT

A compact knockdown kit assembly of cooperative parts for constructing and utilizing a hanging vertical storage pole and comprising a plurality of tubular pole sections arranged to be connected together by joint connector into end-to-end relation. In the kit the joint connector defines a space between the pole sections within which pole accessories are housed, and the kit is wrapped for convenient handling as a single package. A suspension cord is provided at the top of the pole for connection to an overhead support. Hanging hooks are arranged to be attached by pressure sensitive adhesive to the pole for supporting articles on the pole.

24 Claims, 1 Drawing Sheet

VERTICAL STORAGE POLE ASSEMBLY AND METHOD

This is a continuation of application Ser. No. 808,061, filed Dec. 12, 1985, now abandoned.

BACKGROUND OF THE INVENTION

This invention relates to vertical hanging storage poles, and is more particularly concerned with such poles arranged to be readily marketed in compact knockdown kit assembly.

There has been need for convenient means enabling storage and display of articles such as stuffed toys and the alike in a manner to permit ready viewing and selection, and to relieve shelf space or, other horizontal storage or display surfaces in retail establishments, as well as childrens' nurseries, playrooms, and alike.

In the areas where the foregoing space utilization problem has been prevalent, there is generally unused vertical space that could be used for storage and display purposes if there were some means for accomplishing that purpose, and it is to that end that the present invention is directed.

While one piece poles have been provided for this purpose, when they have been substantially longer than two to three feet, an awkward, unsatisfactory handling, shipment and sales display situation prevails.

SUMMARY OF THE PRESENT INVENTION

It is therefore an important object of the present invention to provide a new and improved knocked down vertical storage and display device, and more particularly, a new and improved vertical hanging storage pole assembly.

Another object of the invention is to provide new and improved means for convenient handling of such a pole assembly in a compact knockdown kit of cooperative parts for constructing and utilizing the pole.

A further object of the invention is to provide a new and improved method of assembling a vertical hanging storage pole structure.

The present invention provides a compact knockdown kit assembly of cooperative parts for constructing and utilizing a vertical hanging storage pole, and comprising a plurality of substantially equal length tubular pole sections disposed in coextensive parallel relation. Tubular connector means adapted for connecting the pole sections in end-to-end relation, serve in the kit assembly as sidewise spacer means between the pole sections. Pole accessories are housed in the space defined by the connector means between the pole sections. Wrapper means retain all of the cooperative parts in the kit assembly together for convenient handling as a single package.

Also provided by the present invention is a new and improved method of providing and assembling the vertical hanging storage pole.

The present invention also provides a new and improved vertical hanging storage pole construction which facilitates the kit assembly packaging of the device.

BRIEF DESCRIPTION OF THE DRAWINGS

Other objects, features and advantages of the present invention will be readily apparent from the following description of a representative embodiment thereof, taken in conjunction with the accompanying drawings, although variations and modifications may be effected without departing from the spirit and scope of the novel concepts embodied in the disclosure, and in which.

DETAILED DESCRIPTION

Figure 1:
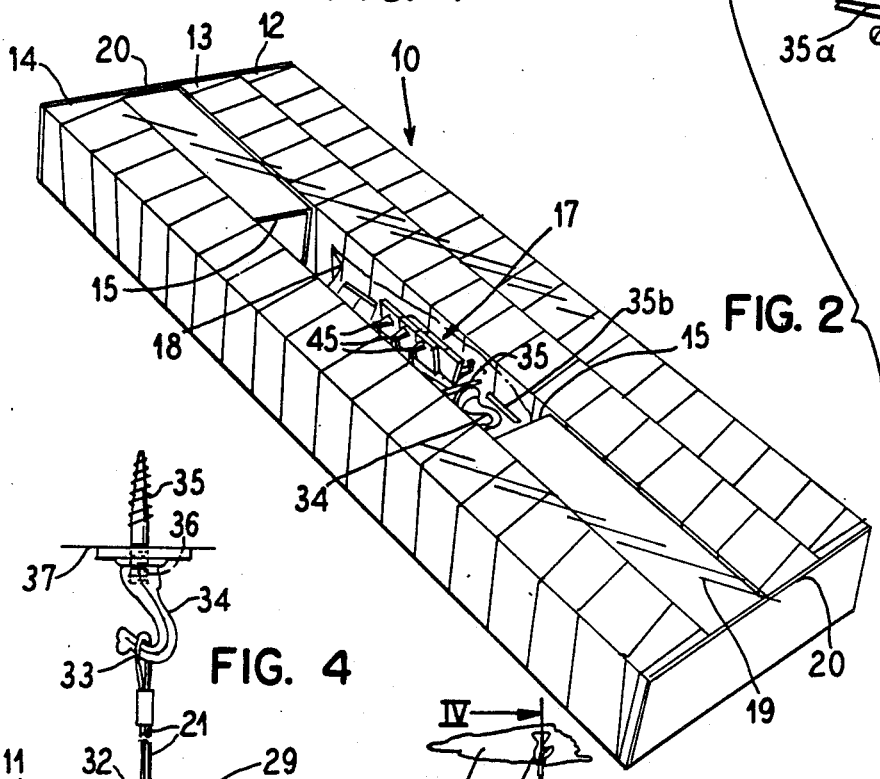
FIG. 1 is a perspective view of a compact knockdown kit assembly of cooperative parts for constructing and utilizing a vertical hanging storage pole according to the present invention.
Figure 2:
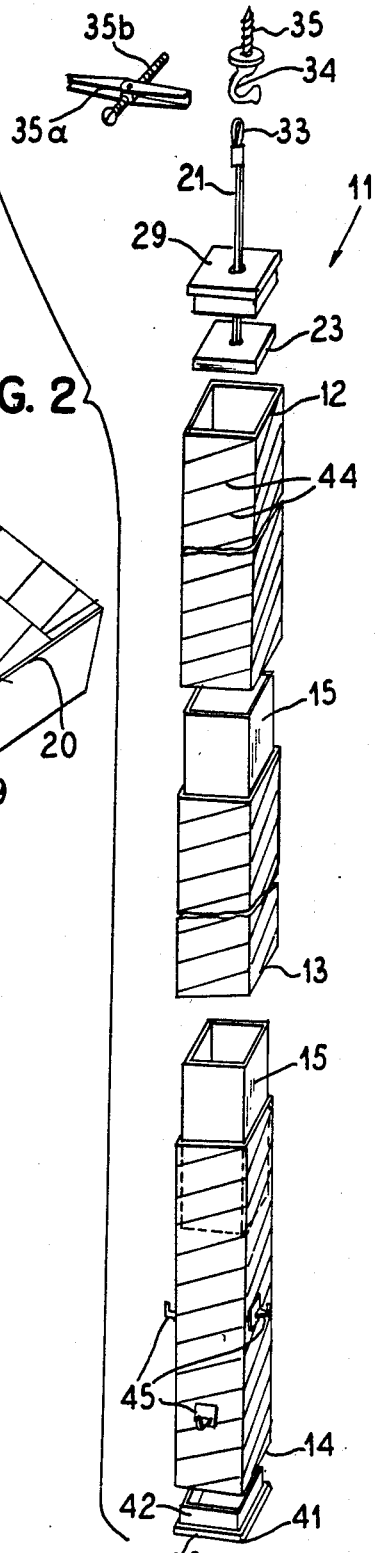
FIG. 2 is an exploded assembly view of the vertical hanging storage pole.
Figure 4:
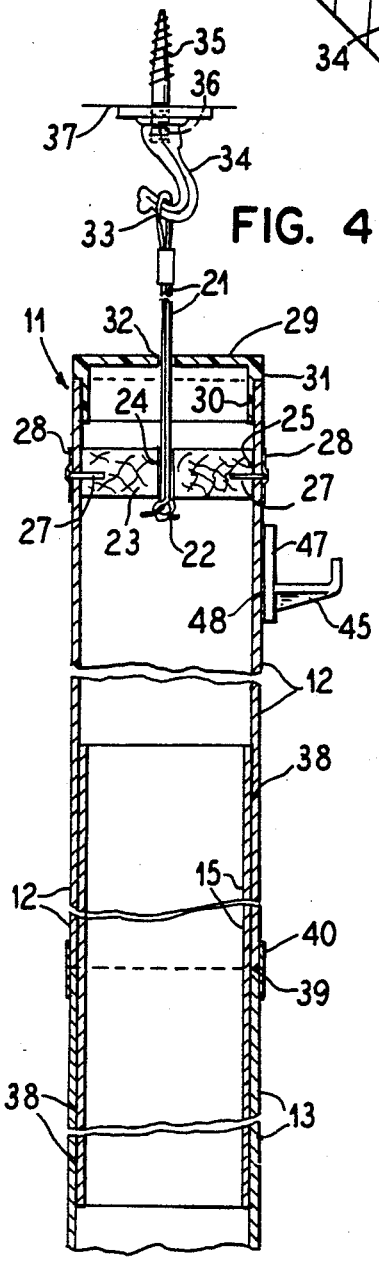
FIG. 4 is an enlarged fragmental sectional detail view taken substantially along line IV—IV in FIG. 3.
Figure 3:
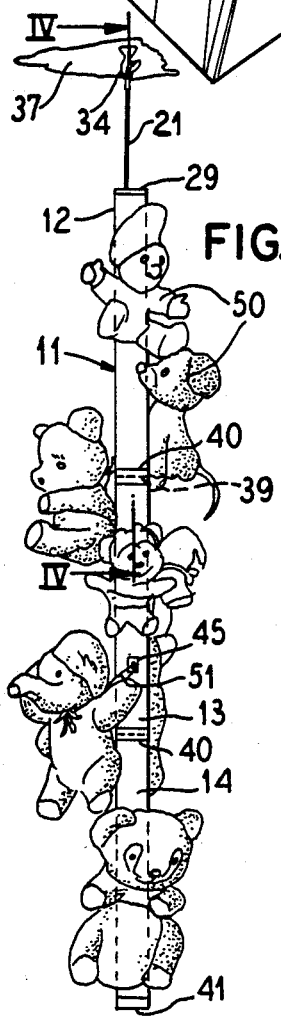
FIG. 3 is an elevational view of the vertical hanging storage pole, showing the same in a suspended mode.
Figure 5:
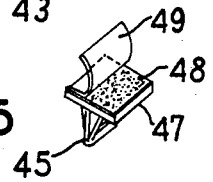
FIG. 5 is a perspective view of one of the self-stick hooks for hanging articles on the suspended pole.

A compact knockdown assembly kit 10 is shown in FIG. 1 containing cooperative parts for constructing and utilizing a vertical hanging storage pole 11 as shown in FIGS. 2, 3, and 4.

The kit 10 comprises a plurality, herein three, substantially equal length tubular pole sections 12, 13 and 14, disposed in coextensive parallel relation. Two of the pole sections, herein the sections 12 and 13, are in side-by-side contiguity. Joint connector means, desirably comprising a pair of tubular connectors 15, adapted for connecting the pole sections 12, 13 and 14 in end-to-end relation, serve in the kit assembly 10 as sidewise spacers between the third pole section 14 and the adjacent pole section 13. As will be observed, the connectors 15 define a space between the pole sections and are substantially shorter than the pole sections 12, 13, and 14. In the kit 10 the connectors 15 are spaced apart endwise and located adjacent to the respective opposite ends of the pole sections and retain the pole sections against relative skewing in the kit assembly.

Pole accessories 17 are housed in the kit assembly between the spaced ends of the connectors 15, desirably in a sack 18, which may be transparent plastic bag or sack.

Wrapper means for retaining all of the parts in the kit assembly relationship and for convenient handling as a single package, desirably comprises a shrink wrap 19 of suitable plastic film. A respective package reinforcing and stabilizing end panel 20 is provided within each end of the package for engaging the pole section ends for retaining the pole sections in coextensive alignment within the relatively flimsy thin plastic film wrap 19.

Each of the pole sections 12, 13, and 14 is desirably of rectangular, preferably square tubular cross section and formed from suitable gauge cardboard so as to to provide a fairly stiff tube thoroughly resistant to deformation and of high tensile strength for the intended purpose. For example, each of the pole sections may be formed from material which is on the order of 0.093" thick, and the outside cross sectional dimensions may be 2"×2". Each of the pole sections may be 20" in length to attain a 60" length when asembled end-to-end .

Each of the connectors 15 desirably comprises an about 6" length of tubing, which may be formed from the same material as the pole sections. In cross sectional dimension, each of the connectors 15 is complementary to the inside cross sectional dimensions of the pole sections so as to be received in fairly snug sliding relation within the contiguous end portions of the pole sections in the assembled pole 11.

The pole section 12 has been devised to be the uppermost section in the pole 11, as best seen in FIGS. 2–4. For this purpose, the upper end of the pole section 12 is provided with a suspension cord 21, which has a stop shoulder knot 22 at its lower end for engagement with the lower side of a suspension block 23 that has a central hole 24 for passage of the cord. The block 23 may be a wood piece having a rectangular dimension complementary to the inside dimension of the upper end portion of the pole section 12. For securing the suspension block 23 suitably spaced from the upper end of the pole section 12, the perimeter of the block may be secured by means of adhesive 25 to the contiguous inside surfaces of the pole section, and for greater stability may also be secured as by means of staples 27 driven through the wall of the pole section 12 into the block, as best seen in FIG. 4. At the outside of the pole section 12, the heads of the staples 27 may be concealed by means of respective labels 28 which may be adhesively secured to the pole section.

For durability and neatness of appearance, the upper extremity of the pole section 12 is equipped with a reinforcing and decorative end cap 29 which may comprise a molded plastic member having a skirt 30 dimensioned to fit snuggly frictionally within the pole section 12. A lateral collar flange 31 about the top of the cap 29 rests against the top terminal edge of the pole section 12. A central hole 32 in the cap 29 passes the cord 21 therethrough.

At its upper end, the cord 21 has a loop 33 adapted to engage a ceiling hook 34, which may be of the swag hook type, secured as by means of a screw 35 to an overhead support, such as a rafter or ceiling 37. If necessary, a conventional expansion plug (not shown) may be provided for anchoring the screw 35. On the other hand, a toggle bolt, **35*a*, having a screw, 35*b*, may be used for attaching the hook 34 to a ceiling panel. The hook 34 has a threaded base socket 36 for receiving the threaded butt end of the screw 35 or the threaded end of the toggle bolt screw 35*b***.

For securing the pole sections in end-to-end relation, one of the connectors 15 is assembled about half within the lower end portion of the upper pole section 12 and about half in the upper end portion of the intermediate pole section 13, and secured therein as by means of adhesive 38. This forms a joint 39 at the snugged up contiguous ends of the pole sections 12 and 13. If desired, the joint 39 may be concealed by means of a tape 40 secured adhesively about the joint along the outside of the contiguous portions of the pole sections 12 and 13.

In similar fashion, the lower end of the intermediate pole section 13 and the upper end of the lower pole section 14 are secured together in aligned assembly by means of the remaining connector 15 which is inserted about halfway into each of the pole section 13 and 14 and adhesively secured within these pole sections in the same manner and to the same effect as the pole sections 12 and 13 are secured in alignment. The joint between the pole sections 13 and 14 may also be concealed by an applied adhesively secured tape 40.

At its lower end, the lower pole section 14 is desirably provided with an end cap 41, similar to the end cap 29, but not necessarily provided with a hanging cord hole. A skirt 42 on the end cap 41 fits in frictionally retained relation within the lower end of the pole section 14, and a stop flange collar 43 abuts the adjacent terminal edge of the pole section 14. This provides an attractive ornamental, structurally reinforced lower end for the pole 11.

One of the desirable attributes of the non-circular construction of the pole 11 is that when assembling the pole sections 12, 13 and 14 in end-to-end relation, matching ornamental design on the outer surfaces on the tube sections can be easily alligned to maintain a desirable ornamental appearance. For example, the pole sections may be provided with a generally spiral ornamental stripe design 44 which can be readily matched at the joints between the pole sections so that a uniform appearance of the stripe design is attained along the length of the pole 11.

At any desired suitable intervals along the outer faces provided by the pole 11, article hanging hooks 45 are mounted. Each of the hooks 45 has a base 47 desirably carrying a layer of pressure sensitive adhesive 48 which is covered with a strippable sheet 49 that can be peeled off when the hook is to be mounted on the pole.

Where, for example, the hanging pole 11 is to support an array of stuffed animal or doll toys 50, each of the toys may be provided with a hang-up string 51 (FIG. 3) looped thereon and by which the toy can be hung on one of the hooks 45.

All of the accessories, comprising the tape strips 28, the swag hook 34, the rafter screw 35, the toggle bolt **35*a*, the screw 35*b*, the hanging hooks 45, and an instruction sheet if desired, are conveniently contained in the sack container 18 in the kit 10**, ready for use when needed.

Availability of all of the cooperative parts within the kit 10 for assembling them into the hanging storage pole 11 is easily effected by stripping off the wrap 19.

It will be understood that variations and modifications may be effected without departing from the spirit and scope of the novel concepts of the present invention.

I claim as my invention:

1. A method of constructing a vertical storage pole from an assembly of cooperating parts, comprising:

providing a plurality of non-circular tubular pole sections having external decorative means;

slidably inserting a connector having non-circular shape complementary to inside dimensions of said pole sections partially into an end portion of at least one of said plurality of pole sections so that a portion of said connector extends from said end portion;

aligning said plurality of pole sections end-to-end with said portion of said connector extending from said end portion facing a neighboring one of said plurality of pole sections;

substantially matching said external decorative means of neighboring ones of said plurality of pole sections; and assembling said neighboring one of said pole sections over said portion of said connector so that respective ends of said pole sections abut one another and form a joint to maintain said pole sections in alignment and maintain said pole sections against relative rotation, said substantially matched external decorative means providing a substantially continuous composite decorative appearance on said vertical storage pole.

2. A method according to claim 1, which comprises wrapping concealing tape about said joint between the aligned end portion of said pole sections.

3. A method according to claim 1, which comprises providing said connector and said pole sections in the form of non-metallic tubular material.

4. A method according to claim 1, which comprises providing said pole sections and said connector in a rectangular cross-sectional shape.

5. A method according to claim 1, which comprises adhesively securing said connector to said pole sections.

6. A method according to claim 1 which comprises applying a concealing tape about said joint.

7. A method according to claim 1, which comprises assembling within the upper end portion of the uppermost pole section, a complementary suspension block having an upwardly extending suspension member for suspending the pole assembly from an overhead support, and block-securing elements driven through the adjacent wall of the upper pole section into said block and thereby securing said block in stable relation to said upper pole section.

8. A method according to claim 7, which comprises securing label means at the outside of the said upper pole section and in concealing relation to heads of said securing elements.

9. A method as claimed in claim 1, wherein said external decorative means includes a spiral ornamental stripe, wherein said step of substantially matching includes matching ends of said spiral ornamental stripe at said facing end portions of said neighboring pole sections, and wherein said step of assembling provides a substantially uniform continuous ornamental stripe along substantially the length of said storage pole.

10. A method of constructing a vertical storage pole from an assembly of cooperating parts, comprising:

providing a plurality of tubular pole sections;

assembling said sections with adjacent end portions thereof at a joint in an end-to-end substantially abutting alignment;

while effecting said alignment slidably inserting a connector which is complementary to the inside dimensions of the aligned pole section end portions across said joint and partially into each of said aligned end portions;

securing said connector and said end portions permanently together;

providing an elongated hanging member to project upwardly from the upper end portion of the pole assembly so that the assembly can be suspended from an overhead support;

providing a suspension member on said upper end portion of said pole assembly;

securing the suspension member to said upper end portion of the pole assembly; and attaching said hanging member to said suspension member.

11. A method according to claim 10, which comprises applying a concealing tape about said joint.

12. A method according to claim 10, which comprises providing said suspension member in the form of a complementary suspension block within the tube wall defining said upper end portion of the pole assembly, and driving block-securing elements through said wall of the upper pole section into said block and thereby securing said block in stable relation to said pole assembly.

13. A method according to claim 12, which comprises securing labels at the outside the said upper end portion tube wall and in concealing relation to heads of said securing elements.

14. A method according to claim 10, which comprises providing said connector and said pole sections in the form of non-metallic tubular material.

15. A method according to claim 10, which comprises providing said pole sections and said connector in a rectangular cross-sectional shape.

16. A method according to claim 10, which comprises adhesively securing said connector to said pole sections.

17. A vertical storage pole construction having an assembly of cooperating parts, and comprising:

a plurality of tubular pole sections;

said sections having adjacent end portions thereof at a joint in an end-to-end substantially abutting alignment;

a slidably inserted alignment maintaining connector complementary to the inside dimensions of the aligned pole section end portions extending across said joint and partially into each of said aligned end portions;

adhesive means securing said connector and said end portion permanently together;

an elongated hanging member projecting upwardly from the upper end portion of the pole assembly so that the assembly can be suspended from an overhead support;

a suspension member on said upper end portion of said pole assembly;

means securing the suspension member to said upper end portion of the pole assembly; and means attaching said hanging member to said suspension member.

18. An assembly according to claim 17, which comprises a concealing tape applied about said joint.

19. An assembly according to claim 17, wherein said suspension member is in the form of a complementary suspension block within the tube wall defining said upper end portion of the pole assembly, and block-securing elements driven through said wall of the upper pole section into said block and thereby securing said block in stable relation to said assembly pole.

20. An assembly according to claim 19, having labels secured at the outside the said upper pole section and in concealing relation to said securing elements.

21. An assembly according to claim 17, wherein said connector and said pole sections are in the form of non-metallic tubular material.

22. An assembly according to claim 17, wherein said pole sections and said connector are in a rectangular cross-sectional shape.

23. A vertical storage pole construction having an assembly of cooperating parts, and comprising:

a plurality of tubular pole sections comprising an upper pole section and a lower pole section;

said upper section having a lower end portion thereof at a joint in end-to-end alignment with an upper end portion of said lower section;

a slidably assembled alignment maintaining connector shorter than said sections and complementary to the cross sectional dimensions of the aligned pole section end portions and extending across said joint and in partially lapping relation to each of said aligned end portions;

adhesive means securing said connector and said end portions permanently together and thereby enabling said lower pole section to be suspendingly supported by said upper pole section;

an elongated hanging member projecting upwardly from the upper end portion of the pole assembly so that the assembly can be suspended from an overhead support;

suspension means on said upper end portion of said pole assembly; and means attaching said hanging member to said suspension means.

24. An assembly according to claim 23, wherein said suspension means comprises a member engaging the upper end of said upper section, and means securing said member to said upper section.

* * * * *